US006715587B2

(12) United States Patent
Sittler et al.

(10) Patent No.: US 6,715,587 B2
(45) Date of Patent: Apr. 6, 2004

(54) LOAD CARRYING MEANS FOR CABLE ELEVATORS WITH INTEGRATED LOAD MEASURING EQUIPMENT

(75) Inventors: Denis Sittler, Illach (FR); Urs Baumgartner, Merenschwand (CH)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 10/283,782

(22) Filed: Oct. 30, 2002

(65) Prior Publication Data

US 2003/0111301 A1 Jun. 19, 2003

Related U.S. Application Data

(63) Continuation of application No. PCT/CH01/00265, filed on Apr. 26, 2001.

(30) Foreign Application Priority Data

May 1, 2000 (EP) ..... 00810371

(51) Int. Cl.[7] ..... B66B 11/02
(52) U.S. Cl. ..... 187/401; 187/277; 187/281
(58) Field of Search ..... 187/277, 281, 187/391, 393, 401; 73/1.09, 1.15, 763, 783, 796, 811; 177/132, 142, 147

(56) References Cited

U.S. PATENT DOCUMENTS 4,113,064 A * 9/1978 Shigeta et al. ..... 187/414
4,573,542 A 3/1986 Schlegel et al.
5,421,433 A * 6/1995 Yoo ..... 187/391
6,305,503 B1 * 10/2001 Suzuki et al. ..... 187/393
6,443,266 B2 * 9/2002 Murakami et al. ..... 187/401
6,483,047 B1 * 11/2002 Zaharia et al. ..... 177/142

FOREIGN PATENT DOCUMENTS

| | | |
|---|---|---|
| EP | 0 151 949 | 8/1985 |
| EP | 0 953 537 | 11/1999 |
| EP | 0 983 957 | 3/2000 |

* cited by examiner

*Primary Examiner*—Jonathan Salata
(74) *Attorney, Agent, or Firm*—MacMillan, Sobanski & Todd, LLC

(57) ABSTRACT

A load carrying and measuring apparatus for cable elevators includes a support construction attached to an underside of a base frame or a carrier frame for an elevator car and a pair of cable rollers attached below the support construction for engaging a support cable. A resilient element attaches at least one of the cable rollers to the support construction whereby the resilient element is deformed by load-dependent cable forces acting through the cable roller. A sensor detects the deformation of the resilient element and sends a signal to the elevator control. A resilient isolating element can be connected between the support construction the base frame or the carrier frame.

15 Claims, 2 Drawing Sheets

LOAD CARRYING MEANS FOR CABLE ELEVATORS WITH INTEGRATED LOAD MEASURING EQUIPMENT

This is a continuation of Application No. PCT/CH/0100265 filed Apr. 26, 2001.

BACKGROUND OF THE INVENTION

The present invention relates to load carrying means for cable elevators with integrated load measuring equipment, in which the weight of the load carrying means and the useful load being carried causes a load-proportional deformation of at least one resilient element, wherein at least one sensor detects this deformation and generates, at an elevator control, a signal representing the amount of the deformation and thus the load.

Load measuring equipment for load carrying means of elevators has the task of preventing elevator travel with an impermissibly high load and of delivering, to the elevator control, data which enables the control to react, independently of the instantaneous load state of the load carrying means, in suitable manner to call commands by elevator users.

The European patent document EP 0 151 949 shows load measuring equipment for an elevator which is based on the principle that the entire elevator car is supported on at least four bending girders projecting from an elevator car base frame in such a manner that these bending girders experience a load-proportional bending deflection. The bending deflection of each individual bending girder is detected by means of strain gauges. All strain gauges form in common a measurement bridge that delivers a load-proportional analog signal to the elevator control.

The above-described prior art load measuring equipment has some disadvantages. The measuring principle requires four bending girders each equipped with a respective strain gauge or two respective strain gauges, wherein the mechanical tolerances of the bending girders as well as the resistance tolerances and mounting tolerances of the strain gauges have to be closely limited in such a manner that all four bending sensors have the same resistance values for the same loads. All four or eight strain gauges have to be individually connected with a central evaluating circuit, which occasions substantial cost. Moreover, the four force introduction points between the base of the elevator car and the bending girders have to be adjusted in vertical direction when being mounted so that an acceptable force distribution is ensured.

SUMMARY OF THE INVENTION

The present invention concerns a load carrying means for cable elevators including: a support construction adapted to be attached to an underside of a base frame or a carrier frame for an elevator car; a pair of cable rollers positioned below the support construction; a resilient element attaching at least one of the cable rollers to the support construction whereby when the support construction is attached to the underside of the elevator car and the cable rollers are engaged by a support cable supporting the elevator car, the resilient element is deformed by load-dependent cable forces acting on the resilient element through the at least one cable roller; and a sensor means for detecting the deformation of the resilient element. The load carrying means also can include a resilient isolating means attached to the support construction and adapted to be attached to the base frame or the carrier frame.

The present invention is based on the object of creating simple and economic load measuring equipment for loading carrying means of elevators with underslung cable drive, which does not have the above-mentioned disadvantages.

The load carrying means according to the present invention for cable elevators with integrated load measuring equipment has significant advantages. The detection of the total weight of the load carrying means and thus also the useful load is carried out by means of a single sensor, wherein even eccentrically disposed useful loads are correctly detected by this. Thus, costs for further sensors, for the wiring thereof and for the complicated signal evaluation thereof are saved. The resilient element, the deformation of which—caused by the weight of the load carrying means—is detected by the sensor, is part of the support construction by which the cable rollers are fastened to the load carrying means. Consequently, substantially no additional mechanical constructional elements and no additional insulation space are needed for the load measuring equipment.

The resilient element, the load-dependent deformation of which is detected by a sensor, can be conceived for different forms of loading, i.e. it can be designed as, for example, a bending girder, a tension/compression rod, a torsion rod or, for attainment of greater deformation travels, a compression, tension or torsion spring. Thus, load measuring equipment optimally adapted to different forms of load carrying means can be constructed.

Advantageous and economic embodiments of the load carrying means according to the present invention with integrated loading measuring equipment can be achieved through use of sensor principles adapted to geometric relationships, environmental influences and, in particular, demands on accuracy. The invention permits use of the most diverse sensors for deformation detection, such as, for example, strain gauges, vibrating string sensors, opto-electrical distance or angle sensors and inductively or capacitively functioning distance sensors.

Depending upon the form of the load carrying means it can be advantageous to allow the two cable rollers mounted below the load carrying means to act directly on a common resilient element. The advantages can be a symmetrical, simple execution of the support construction between the cable rollers and the load carrying means for improved deformation measurement possibilities.

In the case of restrictive geometric relationships in the vicinity of the underlying cable rollers, or in the case of selection of specific forms of sensor, it can be advantageous to allow only one of the two cable rollers to act on a resilient element. The support constructions for the two cable rollers can in that case be executed as separate and differently formed units and no mechanical connections between these units are required. Such embodiments are made possible by the fact that in the case of the underslung arrangement, in accordance with the present invention, of the support cables both cable rollers always experience the same loading.

Load carrying means for greater loads are usually equipped with a carrier frame. In the case of such embodiments it is generally of advantage to fasten the support construction or constructions, which contains or contain the resilient element and which supports or support the cable rollers, to this carrier frame.

In the case of load carrier means for smaller useful loads, these can be executed as a self-supporting unit. The support construction or constructions carrying the cable rollers and containing the resilient element is or are in that case in an advantageous manner fastened directly to the base construction of the load carrying means.

In order to reduce the transmission of vibrations and sound waves from the support cables to the load carrying means it is advantageous to arrange isolating elements between the load carrying means and the support construction or constructions for the cable rollers.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
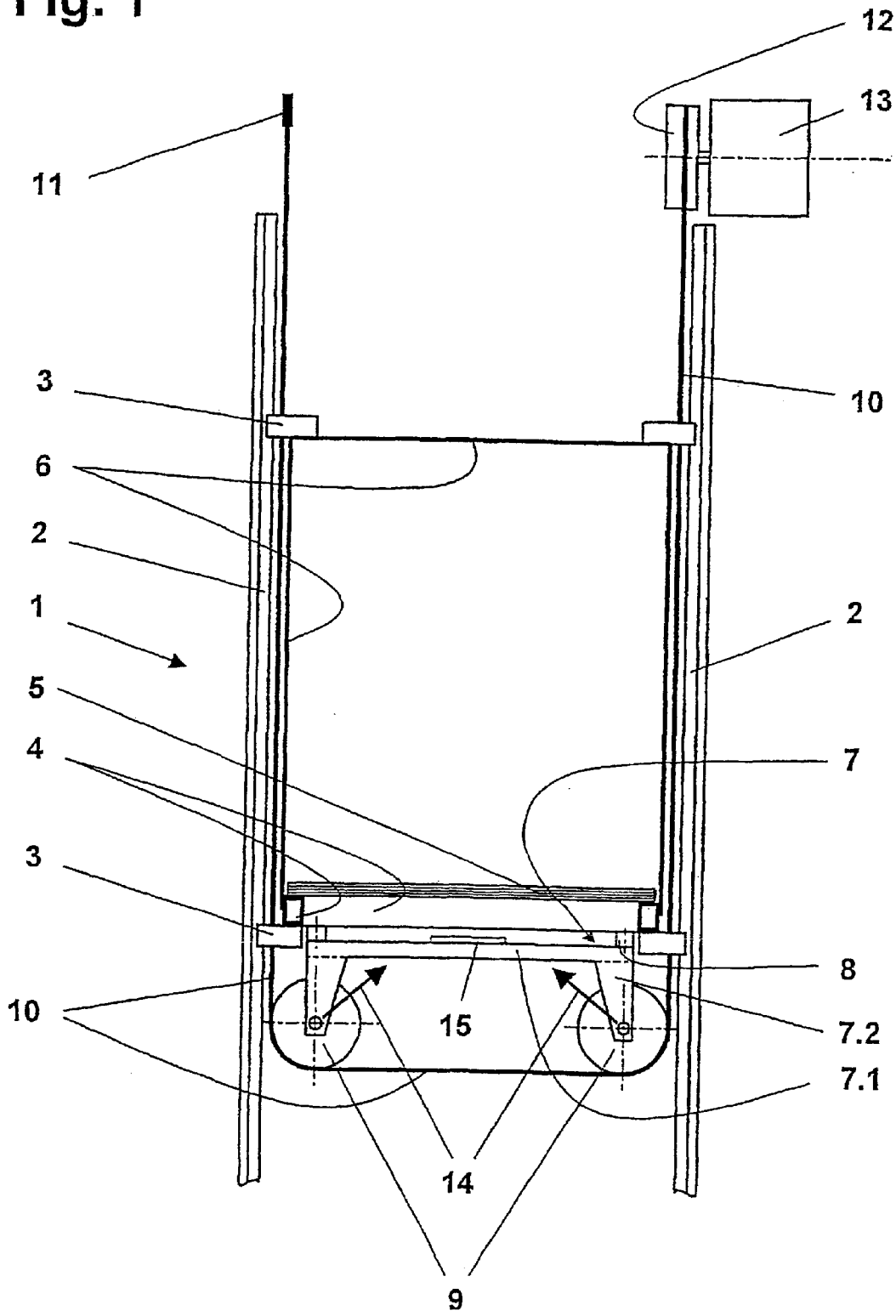
FIG. 1 is a schematic view of a load carrying means installation without a carrier frame and with a first embodiment of an integrated load measuring equipment according to the present invention.

A load carrying means 1 in accordance with the invention, without a carrier frame, is illustrated in FIG. 1 together with the elevator components most important for its function. Two vertically extending guide rails 2 are provided at which the load carrying means is vertically guided by means of slide or roller guide shoes 3. This load carrying means 1 essentially consists of a base frame 4 with a base plate 5, a car 6 installed thereon, the slide or roller guide shoes 3 and two cable rollers 9 fastened to the base frame 4 by means of a support construction 7 by way of resilient isolating elements 8. While a carrier frame for the car 6 is not used in this first embodiment, the support construction 7 can be attached to a conventional carrier frame. The support construction 7 consists of a resilient element such as a bending girder 7.1 and two cable roller supports 7.2. Also shown in FIG. 1 is a support cable 10, which is led from a cable fixing point 11 above the top of the guide rails 2 vertically downwardly engaging one of the cable rollers 9, then horizontally below the cable rollers 9 engaging the other cable roller, and subsequently vertically upwardly to a drive pulley 12 of an elevator drive machine 13 mounted above the top of the guide rails 2. The further course of the support cable 10 from the drive pulley 12 downwardly to a deflecting pulley mounted at a counterweight and from there upwardly to a second cable fixing point is not illustrated here.

A vertical and a horizontal load-proportional cable tension force acts on each of the two cable rollers 9. Arrows 14 represent the cable roller loads acting on the cable rollers 9 and thus on the support construction 7 and resulting from the cable tension forces of the support cable 10. It is readily recognizable that these force resultants produce a bending moment in the bending girder 7.1 of the support construction 7 and thus a bending deflection. This bending deflection is detected by a bending sensor 15, for example a strain gauge sensor, which is not explained here in more detail and which produces, as an input for an elevator control, a signal corresponding with the strength of the bending deflection and thus with the overall weight of the load carrying means 1.

Figure 2:
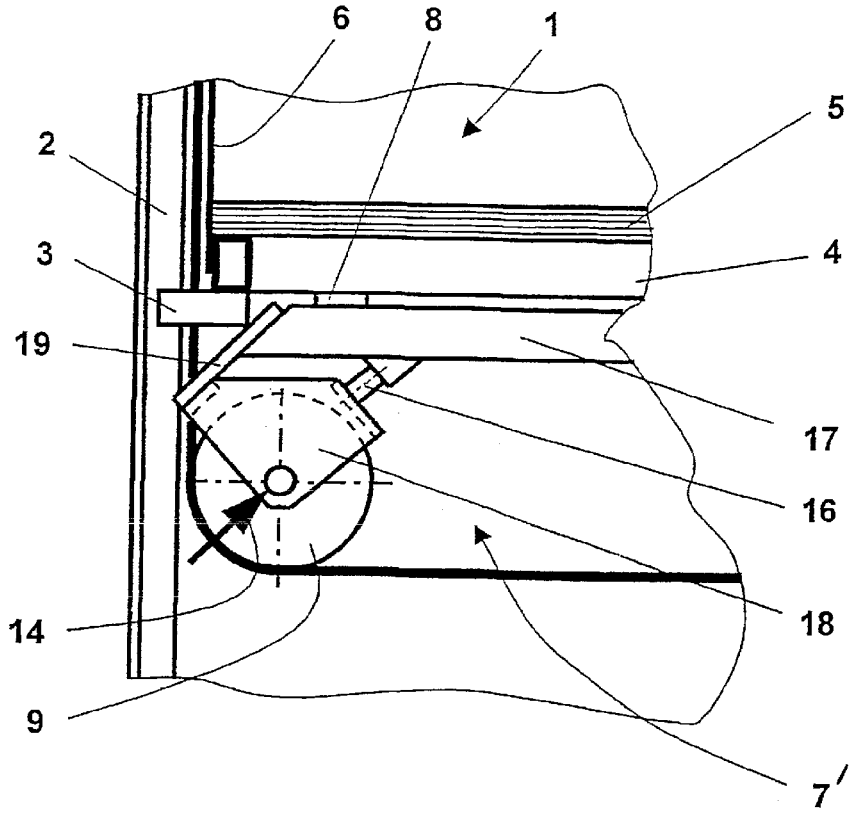
FIG. 2 is a schematic view of a load carrying means installation without a carrier frame and with a second embodiment of an integrated load measuring equipment according to the present invention.

A second embodiment of the loading carrying means according to the present invention with integrated load measuring equipment is illustrated in FIG. 2. The load carrying means 1 guided at the guide rails 2 by means of the slide or roller guide shoe 3, together with the base frame 4, the base plate 5 and the car 6, are similar to the like numbered components shown in FIG. 1. A support construction 7' supporting the cable rollers 9 essentially consists of a fastening carrier 17, which is mounted at the base frame 4 by way of the resilient isolating elements 8, and two cable roller supports. The cable roller support, which is not illustrated and is positioned to the right, corresponds with the cable roller supports 7.2 according to FIG. 1. A cable roller support 18 at the left-hand side is pivotably fastened to the fastening carrier 17 by means of a bending element 19 and is supported relative to the carrier by way of a tension/compression rod pressure sensor 16. The pivot mounting of the cable roller support 18 could obviously also be achieved by a pivot axle. The cable roller load, represented by the arrow 14, resulting from the cable tension forces of the support cable 10 causes a load-proportional pressure force on the pressure sensor 16, which also forms the resilient element and which produces a signal, which corresponds with the total weight of the load carrying means 1, as an input for an elevator control. The pressure sensor 16 can be executed as, for example, a piezoelectric element, a capacitive sensor or a strain gauge element.

Figure 3:
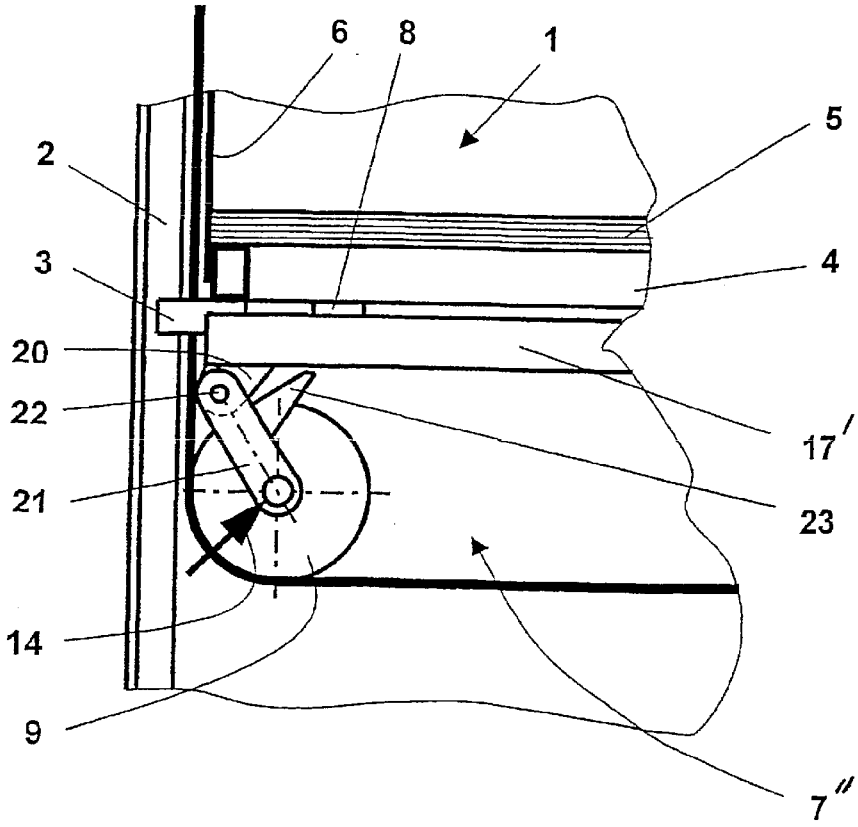
FIG. 3 is a schematic view of a load carrying means installation without a carrier frame and with a third embodiment of an integrated load measuring equipment according to the present invention.

FIG. 3 shows a third embodiment of the load carrying means according to the invention with integrated load measuring equipment. The load carrying means 1 guided at the guide rails 2 by means of the guide or roller guide shoe 3, together with the base frame 4, the base plate 5 and the car 6, are similar to the like numbered components shown in FIG. 1. A support construction 7" supporting the cable rollers 9 essentially consists of a fastening support 17', which is mounted at the base frame 4 by way of the resilient isolating elements 8, with a left-hand bearing support 20 and two cable roller supports. The cable roller support, which is arranged on the right and not illustrated here, corresponds with the cable roller supports 7.2 according to FIG. 1. A left-hand cable roller support 21, which is shown here and constructed as a pivot lever, is fastened to a resilient element such as a torsion rod 22 and rotatably mounted by way of this in the bearing support 20 connected with the fastening support 17'. An abutment 23 prevents overloads of the torsion rod 22. This abutment 23 is extended rearwardly beyond the bearing support 20 (into the plane of the drawing) and connected at its rearward end with the fastening support 17' to be secure against relative rotation. The cable roller load, represented by the arrow 14, resulting from the cable tension forces of the support cable 10 produces, by way of the cable roller support 21 constructed as a pivot lever, a load-proportional torque which twists the torsion rod 22 and induces corresponding load-proportional torsional stresses therein. In the region where the torsion rod 22 is free, i.e. between the bearing support 20 and its rearward fastening, the torsion rod is equipped at its surface with a torsional stress sensor in the form of strain gauges, with the help of which the torsional stresses and thus the torque are detected and a signal corresponding with the total weight of the load carrying means 1 is produced as an input for an elevator control.

Obviously usual commercial torque measuring apparatus based on different measurement principles can also be used as a torque sensor. For example, sensors such as a vibrating string sensor, a travel sensor, an opto-electrical distance or angle sensor, an inductive distance sensor or a capacitive distance sensor can be used. The resilient element (7.1, 16, 22) can also be a compression spring.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A load carrying means for cable elevators with integrated load measuring equipment comprising:

a support construction adapted to be attached to an underside of an elevator car and including at least one resilient element;

a pair of cable rollers positioned below said support construction, at least one of said cable rollers being rotatably attached to said resilient element; and a sensor means mounted on said support construction for sensing one of bending and twisting of said resilient element whereby when said support construction is attached to the underside of the elevator car and said cable rollers are engaged by a support cable supporting the elevator car, said resilient element is one of bent and twisted by load-dependent cable forces acting on said resilient element through said at least one cable roller.

2. The load carrying means according to claim 1 wherein said resilient element is one of a bending girder, a bending element and a torsion rod.

3. The load carrying means according to claim 1 wherein said resilient element is one of said bending girder and said a bending element, end said sensor means is one of a strain gauge sensor, a piezoelectric sensor and a capacitive sensor.

4. The load carrying means according to claim 1 wherein said resilient element is said torsion rod and said sensor means is a torque sensor.

5. The load carrying means according to claim 1 wherein the load-dependent forces act on said resilient element through both of said cable rollers.

6. The load carrying means according to claim 1, wherein the load-dependent forces act on said resilient element only through said at least one cable roller.

7. The load carrying means according to claim 1 wherein said support construction is adapted to be fastened to a carrier frame for the elevator car.

8. The load carrying means according to claim 1 including a base frame for attachment to a bottom of the elevator car and wherein said support construction is attached to said base frame by resilient isolating elements.

9. A load carrying means for cable elevators comprising:

a base frame adapted to be attached to an underside of an elevator car;

a support construction including at least one resilient element;

a resilient isolating means attaching said support construction to an underside of said base frame;

a pair of cable rollers positioned below said support construction, at least one of said cable rollers being rotatably attached to said resilient element; and a sensor means mounted on said support construction for sensing one of bending and twisting of said resilient element whereby when said base frame is attached to the underside of the elevator car and said cable rollers are engaged by a support cable Supporting the elevator car, said resilient element is one of bent and twisted by load-dependent cable forces acting on said resilient element through said at least one cable roller.

10. The load carrying means according to claim 9 wherein said resilient element is one of a bending girder, a bending element and a torsion rod.

11. A load carrying means for cable elevators with integrated load measuring equipment comprising:

a support construction adapted to be attached to an underside of an elevator car and including at least one resilient element;

a pair of cable rollers positioned below said support construction and being rotatably attached to said resilient element; and a sensor means mounted on said support construction for sensing one of bending and twisting of said resilient element whereby when said support construction is attached to the underside of the elevator car and said cable rollers are engaged by a support cable supporting the elevator car, said resilient element is one of bent and twisted by load-dependent cable forces acting on said resilient element through said cable rollers.

12. The load carrying means according to claim 11 wherein said support construction is formed as an inverted U-profile having said resilient element as a horizontal bending girder connected between two downwardly extending cable roller supports, each of the cable rollers being rotatably mounted at an end of an associated one of said cable roller supports, whereby the cable forces act on said support construction so as to cause a load-depending bending in said bending girder.

13. The load carrying means according to claim 12 wherein said sensor means is mounted on said bending girder.

14. The load carrying means according to claim 11 wherein said support construction includes a fastening carrier with said resilient element being at least one bending element attached to an end of said fastening carrier, one of said cable rollers being rotatably mounted said at least one bending element, whereby the cable forces act on said support construction so as to cause a load-depending bending in said at least one bending element.

15. The load carrying means according to claim 11 wherein said support construction includes a fastening support with said resilient element being at least one torsion rod attached at an end of said fastening support, one of said cable rollers being rotatably mounted on said at least one torsion rod, whereby the cable forces act on said support construction so as to cause a load-depending twisting of said at least one torsion rod.

* * * * *